United States Patent [19]

Gillette et al.

[11] Patent Number: 4,950,497

[45] Date of Patent: Aug. 21, 1990

[54] METHOD AND APPARATUS FOR COATING INTERIOR SURFACES OF OBJECTS

[75] Inventors: Donald J. Gillette, Guilford; Bedrich Hajek, New Haven, both of Conn.

[73] Assignee: S.L. Electrostatic Technology, Inc., New Haven, Conn.

[21] Appl. No.: 366,871

[22] Filed: Jun. 15, 1989

[51] Int. Cl.[5] ..... B05D 7/22; B05D 1/26; B05B 5/057

[52] U.S. Cl. ..... 427/28; 118/622; 118/629; 118/630; 118/DIG. 5; 427/182

[58] Field of Search ..... 427/28, 182, 185; 118/622, 629, 630, DIG. 5

[56] References Cited

U.S. PATENT DOCUMENTS

| | | | |
|---|---|---|---|
| 3,004,861 | 10/1961 | Davis | 427/182 |
| 3,248,253 | 4/1966 | Barford et al. | 427/25 |
| 3,537,426 | 11/1970 | Spiller et al. | 118/629 |
| 3,560,239 | 2/1971 | Facer et al. | 427/46 |
| 3,799,112 | 3/1974 | Huteaux | 118/629 |
| 3,828,729 | 8/1974 | Goodridge | 118/634 |
| 3,914,461 | 10/1975 | Goodridge | 427/33 |
| 3,916,826 | 11/1975 | Knudsen | 118/629 |
| 3,937,179 | 2/1976 | Goodridge | 118/301 |
| 4,011,832 | 3/1977 | Westervelt et al. | 118/301 |
| 4,030,446 | 6/1977 | Karr | 118/654 |
| 4,053,661 | 10/1977 | Goodridge | 427/185 |
| 4,073,265 | 2/1978 | Walling et al. | 118/634 |
| 4,101,687 | 7/1978 | Knudsen | 427/25 |
| 4,123,175 | 10/1978 | Carlson et al. | 366/151 |

FOREIGN PATENT DOCUMENTS 925021 5/1963 United Kingdom .

*Primary Examiner*—Evan Lawrence
*Attorney, Agent, or Firm*—Ira S. Dorman

[57] ABSTRACT

Electrostatic apparatus and method for coating interior surfaces of objects. The apparatus employs a fluidized bed unit in which the fluidization chamber is relatively shallow, and is circumscribed by a marginal portion that conforms closely to the dimensions and configurations of the cavity of the object. The apparatus employs a non-vacuumized powder recovery and recirculation system, and provides a peripheral slot in the marginal portion of the housing for entry of undeposited powder. Coating inside corners of objects is effectively achieved using the method of the invention, and heavy, uniform builds of the particulate material are produced efficiently and at high rates.

23 Claims, 2 Drawing Sheets

METHOD AND APPARATUS FOR COATING INTERIOR SURFACES OF OBJECTS

BACKGROUND OF THE INVENTION

Electrostatic fluidized bed coating is now a conventional and widely-used technique for depositing particulate materials upon a great diversity of workpieces. Methods and apparatus for electrostatic coating are well known in the art, as broadly exemplified by Knudsen U.S. Pat. Nos. 3,916,826 and 4,101,687, issued respectively on Nov. 4, 1975 and Jul. 18, 1978, and Karr U.S. Pat. No. 4,030,446, issued Jun. 21, 1977. The prior art also discloses techniques by which coatings of electrostatically charged particles can be developed progressively upon workpiece surfaces during movement thereof relative to a fluidized bed, as in Goodridge U.S. Pat. Nos. 3,828,729 and 3,914,461, issued respectively Aug. 13, 1974 and Oct. 21, 1975, and Westervelt et al U.S. Pat. No. 4,011,832, issued Mar. 15, 1977; non-electrostatic techniques, carried out similarly, are described in Goodridge U.S. Pat. Nos. 3,937,179 and 4,053,661, issued respectively on Feb. 10, 1976 and Oct. 11, 1977.

Efforts have been made in the past to utilize fluidized bad techniques, of both electrostatic and nonelectrostatic character, for developing powder coatings upon the inside surfaces of objects. Patents disclosing such concepts include Davis U.S. Pat. No. 3,004,861, issued Oct. 17, 1961, Barford et al U.S. Pat. No. 3,248,253, issued Apr. 26, 1966 (see FIG. 10), and Major et al United Kingdom Specification No. 925,021, published May 1, 1963. The Davis patent, in FIG. 2, shows apparatus for coating the inner surface of a tubular conduit utilizing a cup-like container, the container having a vertical wall that terminates in an outwardly flared lip and that closely approaches the surface to be coated. Powdered coating material is fluidized upon a porous plate disposed deeply within the container, and additional material may be supplied through a funnel member that is connected to a tube, which may extend either downwardly into the container or upwardly through the bottom thereof. In applying the coating material the container and conduit are moved relative to one another, and the patentee discloses that the thickness of the coating layer can be regulated by the rate of relative movement. Although a seal may be provided in the region of the flared lip of the container, it is deemed to be nonessential, because the amount of powder which would otherwise be lost is considered to be negligible.

The Major et al specification describes a method and apparatus for applying a coating of powered silica to the inside surface of an incandescent lamp envelope; in some cases the particulate material can be charged electrically by blowing it through a zone of ionization. The apparatus comprises a long glass tube, at the bottom of which is a diffusing pad covered by a layer of glass balls and, in turn, a reservoir located directly beneath the vessel being coated; particles that are too large to be sustained by the upwardly moving gas stream will be returned to the reservoir, and the delivery tube may be moved vertically within the object during the coating operation.

Certain fluidized bed units described in the art employ vacuum systems for exhausting fumes and recovering undeposited powder. Exemplary disclosures are set forth in Facer et al U.S. Pat. No. 3,560,239, issued Feb. 2, 1971, Huteaux U.S. Pat. No. 3,799,112, issued Mar. 26, 1974, and Walling et al U.S. Pat. No. 4,073,265, issued Feb. 14, 1978. A powder handling system, adapted for use with fluidized bed coating equipment, is described in Carlson et al U.S. Pat. No. 4,123,175, issued Oct. 31, 1978.

Despite the activity in the art exemplified by the foregoing, a need exists for means by which interior surfaces of workpieces can be coated quickly and efficiently with a particulate material, so as to produce a heavy and uniform build thereof, which need is particularly acute in regard to workpieces so configured as to present internal corners which must be covered by the coating material. Accordingly, it is a broad object of the present invention to provide a novel apparatus, system and method by which such coatings can be produced on workpieces of the kind described, and in the manner indicated.

An ancillary object of the invention is to provide an apparatus, system and method having the foregoing features and advantages which, in addition, afford means for replenishing the supply of particulate material in the fluidization chamber in an optimal manner.

It is also an object of the invention to provide such an apparatus and system which are relatively economical to build, and which can be used to quickly and conveniently produce high quality coatings of uniform and relatively heavy build.

SUMMARY OF THE INVENTION

It has now been found that certain of the foregoing and related objects of the invention are attained by the provision of electrostatic fluidized bed coating apparatus that includes a housing having a generally planar porous support member mounted therein to define a shallow fluidization chamber and an underlying plenum, the housing being open at the top and having a peripheral wall portion with an upper peripheral edge component extending about the opening. Means is provided for electrostatically charging particulate material supplied to the upper surface of the support member, and for introducing air into the plenum for fluidization of particulate material disposed on the support member. A reservoir chamber is disposed below the plenum, and means is provided for delivering particulate material from the reservoir chamber to the fluidization chamber. The apparatus also includes collection means having at least one wall portion with an upper edge component that substantially surrounds the edge component of the peripheral wall portion of the housing, and that is in substantial horizontal registry with it, the two edge components being spaced from one another to define a narrow, upwardly opening slot extending peripherally about the housing. The collection means is in communication with the reservoir chamber, so that particulate material entering the peripherally extending slot falls into said reservoir chamber, to be returned to the fluidization chamber by the delivery means.

In the preferred embodiments, the outermost element of the peripheral edge component of the collection means will be vertically spaced about 5 to 10 centimeters above the upper surface of the support member. Most desirably, the delivery means will deposit the coating material to a central location on the upper surface of the support member, and the peripheral edge components of the housing and collection means wall portions will have upper surface portions that lie on a common, imaginary inwardly tapered peripheral surface. In one specific form of the apparatus, the upper peripheral edge component of the housing peripheral wall portion will be circular, thus adopting the apparatus for coating the interior surfaces of an object having a cavity of uniform circular cross section.

In those instances in which the object has an end wall, the housing of the apparatus will normally be substantially completely open at the top, to adapt it for coating all of the cavity-defining surfaces. The collection means may comprise a plurality of compartments, each being defined by a sidewall portion that is spaced from the peripheral wall portion of the housing, and by lateral wall portions that converge downwardly to an exit port providing communication with the reservoir chamber, the sidewall portions of the compartments cooperatively providing the upper edge component of the collection means. The reservoir chamber may advantageously be provided by a hopper member that is separate from, and disposed below, the housing, with the collection means including at least one conduit that is connected to the hopper, and means will normally be provided to permit access into the reservoir chamber for introducing fresh particulate material.

The delivery means employed will desirably comprise structure defining a bore that extends vertically between the reservoir chamber and the fluidization chamber, a rotatable screw extending through the bore, and drive means for effecting rotation of the screw so as to lift the particulate material and deposit it at a centralized location with respect to the support member. The lower end of the bore-defining structure will preferably open adjacent the bottom of the reservoir chamber and centrally therewithin, and the apparatus will desirably additionally include means for injecting air under pressure into the reservoir at that location, to effect agitation of the particulate material. The reservoir chamber will normally be open to the atmosphere and, most advantageously, the apparatus will be devoid of means for evacuating any space therewithin.

Other objects of the invention are attained by the provision of a system that includes, in addition to the electrostatic fluidized bed coating apparatus as hereinabove described, means for transporting an object to and away from the vicinity thereof, and adapted to support an open-ended object with its open end downwardly disposed. The system will include means for effecting relative vertical movement between the supported object and the coating apparatus, and generally it will include high voltage supply and air supply means, as well.

Additional objects are attained by the provision of an electrostatic method, utilizing an electrostatic fluidized bed coating apparatus as hereinabove set forth. The method includes the steps of supplying a quantity of particulate material, capable of acquiring an electrostatic charge, to the upper surface of the support member; positioning an elongate object over the coating apparatus, the object having an open end and a cavity of uniform cross section conforming closely to the outer periphery of the fluidized bed unit, and being oriented with its longitudinal axis vertically disposed and with its open end downwardly directed; and effecting relative vertical movement between the object and the apparatus during a cycle consisting of a first phase, in which the apparatus is inserted into the cavity of the object, and a second phase in which the apparatus is withdrawn therefrom. The apparatus is operated during at least a portion of the cycle so as to produce from the particulate material, upon and over the support member, a fluidized bed and a cloud of electrostatically charged particles. The object is maintained, at least during the operating portion of the cycle, at an electrical potential that is effectively opposite to the potential of the electrostatically charged particles, thereby causing the particles to be attracted to, to deposit upon, and to adhere to the surfaces defining the cavity to effect coating thereof. The particulate material that is collected in the reservoir chamber is continuously returned to the fluidization chamber during the coating operation.

In those preferred instances in which the object to be coated has an end wall closing one end, the apparatus will usually be brought to a position proximate the end wall prior to commencement of the coating phase. In most cases the object will be grounded, and the method will usually be carried out to coat a plurality of the objects, each being sequentially positioned and moved as described. The relative movement that occurs between the object and the coating apparatus may, if desired, be effected at a varying rate, which rate variation may be automatically controlled in accordance with a predetermined program; in all instances recovery and recycle of the coating material will advantageously be effected at a pressure that is no lower than atmospheric.

DETAILED DESCRIPTION OF THE ILLUSTRATED EMBODIMENT

Figure 1:
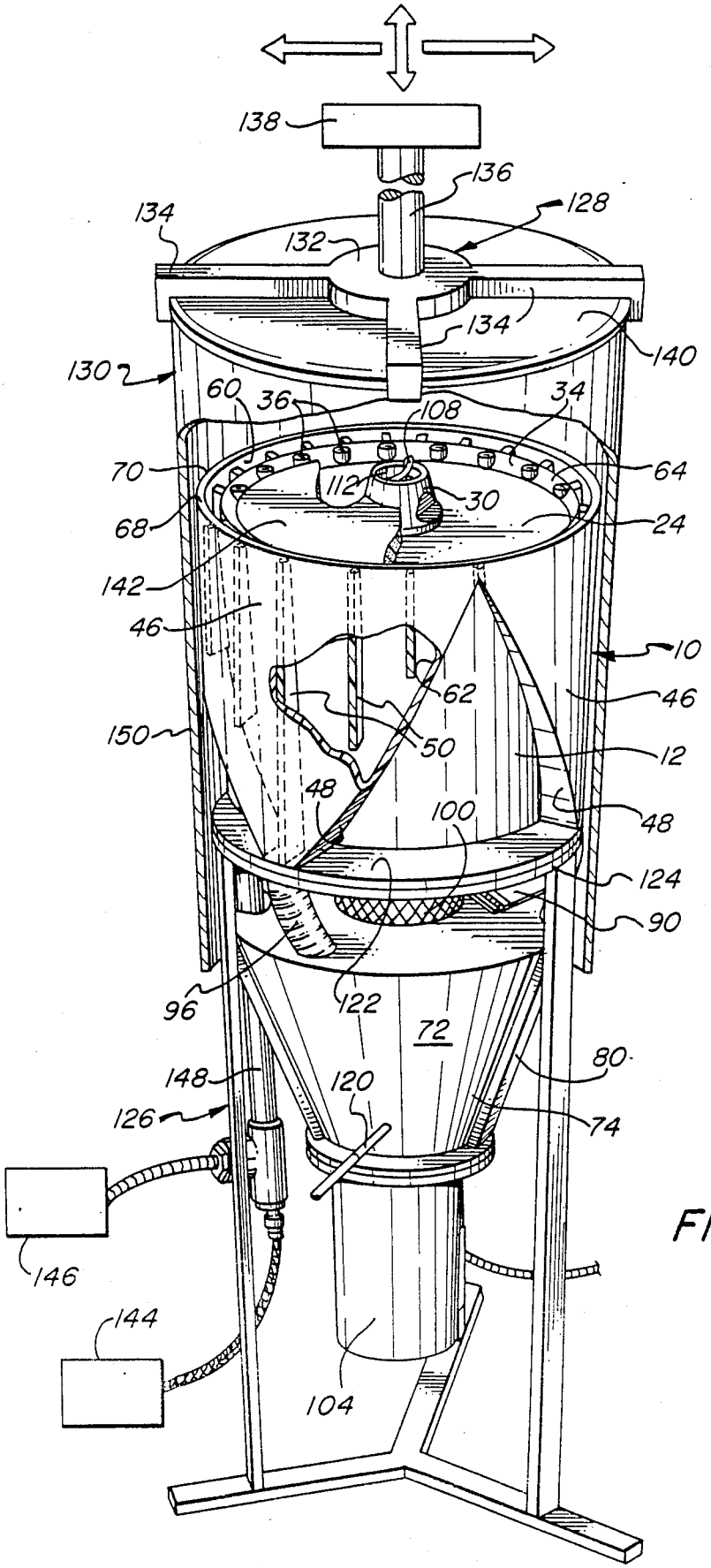
FIG. 1 is a fragmentary perspective view of a system embodying the present invention, showing a cylindrical tank or vessel having one end closed and one end open, during the coating operation.

Turning now in detail to the appended drawings, therein illustrated is an electrostatic coating system embodying the present invention, utilizing a fluidized bed unit comprised of a housing, generally designated by the numeral 10. The housing 10 consists of a frustoconical sidewall portion 12, a base portion 14, and a central core portion 16, cooperatively defining a relatively deep, generally annular plenum 18 therewithin. The sidewall portion 12 is formed with an enlarged, circumferential shoulder 20, which provides a surface 22 upon which the outer marginal portion of an annular porous plate 24 is supported. The core portion 16 has a threaded neck component 26 at its upper end, which extends through the central aperture 28 of the porous plate 24 and engages an internally threaded cap 30, of frustoconical configuration. As will be appreciated, the cap 30 is tightened upon the threaded neck component 26 to secure the inner marginal portion of the porous plate against the shoulder surface 32 formed on the core portion 16 at the base of the neck component 26; the outer marginal portion of the plate is held in place by the clamping piece 34, which is of triangular cross section and is secured by a number of bolts 36.

An annular chamber 38 is formed within the base portion 14 of the housing 10. Electrode means, comprising an array of wire brush-like members 40, are disposed upon the top wall component 44 of the base portion, the latter having small apertures 42 therethrough to provide air-flow communication with the chamber 38. Such an arrangement has been disclosed heretofore (see for example the above-identified Karr patent), and serves to generate ionized air in a highly efficient manner.

Three identical trough-like structures are provided about the housing 10, each defined by an exterior wall portion 46 and two downwardly converging lateral wall portions 48, in cooperation with the section of the sidewall portion 12 that is coextensive with the exterior wall portion 46. A set of five vertical ribs 50 are contained within each trough-like structure for reinforcing purposes, and it will be noted that the ribs aligned over the lateral wall portions 48 terminate short thereof. The lateral wall portions 48 lead to a port 52, from which extends a collar component 54.

Figure 2:
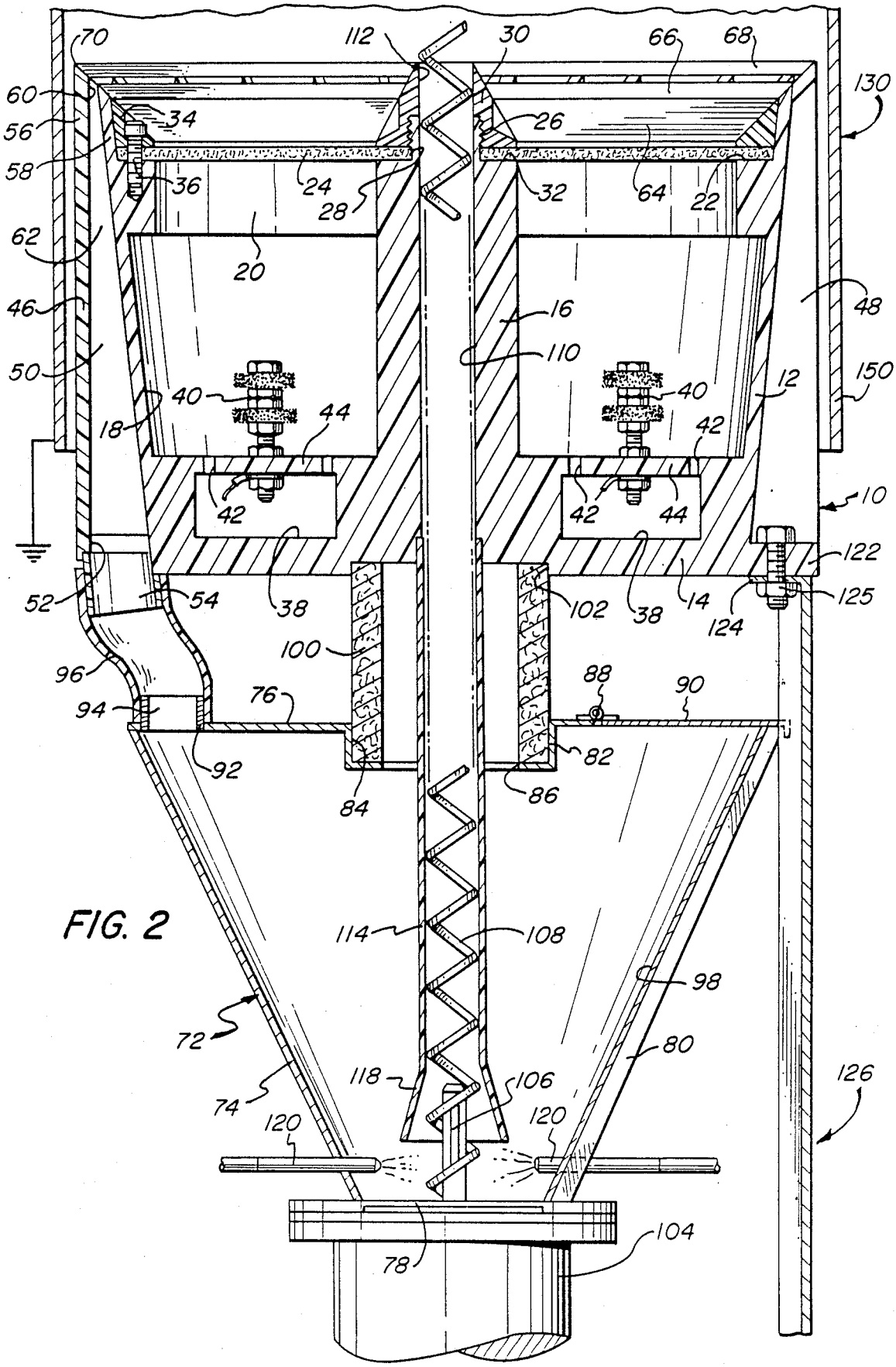
FIG. 2 is a fragmentary vertical sectional view thereof.

The exterior wall portions 46 terminate in a continuous, beveled upper edge component 56, which is spaced slightly from the horizontally aligned component 58 of the sidewall 12, thereby defining a relatively narrow throat portion 60 leading into the spaces 62 within the trough-like structures surrounding the housing. It will be noted from FIG. 2 that the bevelled surfaces 51, 64, 66 and 68 on the internal ribs 50, the clamping ring 34, and the edge component 58 of the sidewall 12, and the edge component 56 of the exterior wall portions 46, respectively, lie on a common, imaginary frustoconical surface, and thereby provide a substantially continuous inclined surface from adjacent the porous plate 24 to the outermost edge element 70 circumscribing the exterior wall portions 46.

A hopper, generally designated by the numeral 72, is disposed beneath the fluidized bed unit and comprises a frustoconical sidewall portion 74, a top wall portion 76, and a bottom wall portion 78, the sidewall portion 74 being reinforced by ribs 80. Ledge structure 82 defines a recess 84 in the top wall 76 of the hopper, and circumscribes a relatively large opening 86. A second opening 88 normally closed by a hinged door 90, and a relatively small port 92 circumscribed by a short collar 94, are also formed in the top wall portion 76. The collar 94 receives one end of a flexible conduit 96, which is engaged at its opposite end upon the collar component 54 that surrounds the port 52 from one of the trough spaces 62 of the coating unit housing; as will be appreaciated, the other trough-like structures are connected to the hopper chamber 98 by similar means. The recess 84 in the top wall portion 76 seats one end of a cylindrical filter element 100, the opposite end of which is seated within a recess 102 that extends upwardly into the base portion 14 of the housing 10.

The bottom wall portion 78 of the hopper 72 supports a variable speed electric motor 104, which has an upstanding shaft 106 to which is attached a screw 108. The screw 108 extends upwardly through the bore 110 within the core portion 16 of the housing, and through the bore 112 of the cap 32 engaged thereupon, protruding a short distance outwardly therebeyond. The lower portion of the screw 108 is received within a rigid cylindrical guide pipe 114, the upper end of which is engaged within a secondary recess 166 formed into the base portion 14; the lower end portion 118 of the pipe 114 is of frustoconical configuration. Three nozzles 120 (only two of which are visible in FIG. 2) extend radially through the bottom of the hopper sidewall 74, to points adjacent the end portion 118 of the guide pipe 114.

Support for the coating apparatus is provided by a stand, generally designated by the numeral 126. The housing of the fluidized bed unit 10 has laterally extending circumferential flange components 122 on its base portion 14, which rest upon the upper ring 124 of the stand 126 and are secured thereto by a nut and bolt fastener 125; the hopper 72 is suspended from the ring 124, by means which is not shown.

As indicated in FIG. 1, the conveyor of the present system includes a multiplicity of attaching fixtures, generally designated by the numeral 128, each of which is capable of supporting an open-ended tank, generally designated by the numeral 130, with its open end downwardly disposed. The fixture 128 consists of a hub 132, from which extends four radial gripping arms 134. The post 136 on the hub may be considered to be the axially movable shaft of a diagrammatically illustrated elevating mechanism 138. As noted by the arrows, the conveyor is adapted to move the supported object to and from the location of the coating unit, as well as vertically with respect thereto. The system will also include a high voltage source 144 and an air source 146, the electrical power and air supply being introduced through the common pipe 148 and being attached, respectively and by means not shown, to the electrode members 40 and the compartment 38 within the base portion 14. The air supply 146 will in addition be connected to the nozzles 120, and suitable valves and other control devices will of course be operatively interposed, as appropriate.

In operation of the system, the tank 130 will initially be carried to a position of axial alignment over the coating apparatus, as may be achieved automatically, and the elevating mechanism 138 associated with the conveyor will then be activated to cause the tank to descend over the fluidized bed unit. When the bottom wall 140 has been brought to a position proximate the fluidization chamber, the coating unit will be fully activated, with air flowing through the chamber 38 and power supplied to the electrode members 40, causing the particulate coating material 142 supplied to the upper surface of the porous plate 24 to be fluidized and electrostatically charged by the ionized air generated within the plenum 18, which flows through the plate 24 into the bed thereof.

The charged particles will of course be attracted to the adjacent surfaces of the grounded tank 130, to deposit initially upon the surface of the end wall 140. Upward withdrawal of the tank will cause the powder to deposit progressively upon the surface of the sidewall 150, as fresh portions become exposed behind the rim 70 of the fluidized bed, thereby gradually developing a deposit over the entire sidewall surface. When the coating operation has been completed, the conveyor will of course carry the tank 130 from the vicinity of the coating apparatus to successive stations of the system, at which the deposited material is fused and hardened by means well-known to those skilled in the art, so as to produce the desired, integrated coating.

It will be appreciated that during operation of the coating unit the fluidized particulate material will flow over the surfaces 64, 66, 68, due to the influence of both the fluidizing air and also the electrostatic attraction induced by the grounded tank 130. Of course, not all of the powder leaving the fluidization chamber will adhere to the tank surface, which is at least in part a consequence of the desirable self-limiting build effect that is characteristic of electrostatic powder coating. A very high proportion of the undeposited or nonadhering powder will enter the throat portion 60 of the trough-like structures on the exterior of the coating unit, and will descend through the interior spaces 62 to ultimately collect in the chamber 98 of the hopper 72 which acts as a reservoir chamber. The screw 108, rotated by the motor 104 (at a speed appropriate to replenish the powder used to coat the workpice, and to maintain a desirable depth thereof on the plate 24), will carry the powder from the hopper upwardly through the pipe 114 and the bores 110, 112, ultimately delivering it to the middle of the porous plate 24; normally, the recirculation system will be operated only during the coating phase. Air injected through the nozzles 120 will serve to agitate the powder in the lower end of the hopper, keeping it from packing and thereby assisting entry into the mouth of the funnel section 118. Pressure buildup within the hopper is avoided by permitting air to escape through the filtered opening 86, and fresh powder is added, as necessary, through the opening 88.

It will be noted that the collection of undeposited particulate material is effected through simple gravitational flow, and without the imposition of any vacuum effect. Not only does the absence of any evacuation system simplify the design of the coating unit and afford economic benefits, but it is also believed to maximize powder deposition and retention on the surfaces being coated, by avoiding air-flow currents that would otherwise be induced.

It is also to be noted that in the normal mode of operation coating is effected only during the withdrawal phase; i.e., during separation of the workpice and the bed. Consequently, any tendency that exists for powder to escape through the gap between the surfaces of the object and the coating unit walls is largely counteracted by the upward movement of the object, relative to the unit, which promotes an upward flow of the particles. While this minimizes the amount of coating material lost from the system, it will usually be desirable, nevertheless, to position a vacuum unit near the open end of the object being coated; such a unit will serve to recover the small amount of material that does escape, or that is dislodged from the coated surface, so as to maintain cleanliness in the work area.

Although, in the illustrated embodiment of the system, a mechanism associated with the conveyor is employed to vary the elevation of the object during coating, it will be appreciated that the means for achieving the necessary relative movement could be incorporated into the coating apparatus instead. Thus, rather than utilizing a stand of fixed configuration, a structure having extensible legs could be provided, with means for extending and retracting the components thereof to raise and lower the coating unit, if so desired.

The shallowness of the fluidization chamber of the coating unit minimizes the distances through which the charged particles must move to deposit upon the workpiece surface, and thereby maximizes the effect of the electrostatic attracting forces. This, coupled with the high density electrostatic field that is created because of the large mass of the grounded object, permits the particulate material to deposit as a heavy, uniform build, even in corners of the object being coated (for example, at the junction of the bottom and sidewall portions 140, 150 of the tank 130). A Faraday's cage effect would normally inhibit such a coating application, and attempts to counteract that effect, such as by blowing powder at high velocity into the corners, have been most unsuccessful. It is also important to note that the configuration of the closed-loop collection and delivery arrangement incorporated into the apparatus not only affords efficiency and convenience of powder handling, but it enhances the effectiveness of coating as well; electrostatic charge transfer is achieved very efficiently as the particulate material migrates uniformly and at an even rate from the point of entry at the center of the bed, and across the porous plate. As can be seen, the plenum of the coating unit is made relatively deep, so as to space the charging electrodes an optimal distance below the porous plate and thereby ensure that no arcing to the workpiece will occur at operating voltages (typically 50 to 60 KV).

The composition of the particulate material employed in the practice of the invention may vary widely, and may include thermoplastic or thermosetting natural and synthetic resinous materials, inorganic oxide powders, and the like. As a specific example, the tank shown in the drawings may be intended for use as a hot water vessel, in which case the particulate material may be a vitreous frit.

In any event, it will be apparent that the overall configuration of the bed will be selected so as to best conform to the shape of the cavity walls that are to be coated. The apparatus of the invention may for example be adapted for the coating of liners for domestic ovens, in which case the bed would have a square configuration. The important consideration is of course to provide a bed in which the marginal structure at the perimeter of the fluidization chamber will lie in close proximity to the object surface, while providing clearance that is just sufficient to permit ready insertion of the coating unit thereinto.

Details of construction of the apparatus, and the nature of the materials suitable for use therein, are now well known in the art, and need therefore not be specifically discussed. It will also be appreciated by those skilled in the art that many variations may be made without departure from the concepts of the invention.

Thus, it can be seen that the present invention provides a novel apparatus, system and method by which heavy and uniform coatings of particulate materials can quickly and efficiently be produced on interior surfaces of workpieces. It is especially notable that the invention permits such coating of objects having internal corners, and that it provides means for optimal handling of the particulate coating material. The apparatus and system of the invention are relatively economical to build, and they are effective and convenient to employ.

Having thus described the invention, what is claimed is:

1. Electrostatic fluidized bed coating apparatus adapted for coating of interior surfaces of objects comprising, in combination: a housing having a generally planar porous support member mounted therein to define within said housing a shallow fluidization chamber thereabove and a plenum therebelow, said housing being open at the top and having a peripheral wall portion with an upper peripheral edge component extending about the opening thereinto; charging means for electrostatically charging particulate material supplied to the upper surface of said support member; means for introducing air into said plenum for fluidization of particulate material disposed on said upper surface; a covered reservoir chamber disposed below said plenum; delivery means for delivering particulate material from said reservoir chamber to said fluidization chamber; and collection means including at least one wall portion providing an upper edge component substantially surrounding said edge component of said peripheral wall portion of said housing and in substantial horizontal registry therewith; said edge components of said wall portions of said housing and collection means being spaced from one another to define a narrow upwardly opening slot extending peripherally about said housing, said collection means being in communication with said reservoir chamber to permit particulate material entering said peripherally extending slot to fall into said reservoir chamber.

2. The apparatus of claim 1 wherein the outermost element of said peripheral edge component of said collection means is vertically spaced about 5 to 10 centimeters above said upper surface of said support member.

3. The apparatus of claim 1 wherein said delivery means delivers the particulate material to a central location on said upper surface of said support member.

4. The apparatus of claim 1 wherein said housing is substantially completely open at the top, said apparatus being adapted for coating the interior surfaces of an object having a sidewall and an end wall closing one end thereof, said sidewall and end wall defining a cavity of uniform cross sectional configuration within the object.

5. The apparatus of claim 1 wherein said peripheral edge components have upper surface portions which lie on a common, imaginary inwardly tapered peripheral surface.

6. The apparatus of claim 1 wherein said upper peripheral edge component of said peripheral wall portion of said housing is circular, said apparatus being adapted for coating the interior surfaces of an object having a cavity of uniform circular cross section.

7. The apparatus of claim 14 wherein said collection means comprises a plurality of compartments, each defined by a sidewall portion spaced from said peripheral wall portion of said housing, and a pair of downwardly converging lateral wall portions, and each having an exit port therefrom to which said converging wall portions lead, said collection means being in such communication with said reservoir chamber through said exit ports, and said sidewall portions of said compartments cooperatively providing said upper edge component thereof.

8. The apparatus of claim 1 wherein said reservoir chamber is provided by a hopper member that is separate from, and disposed below, said housing, said collection means including at least one conduit connected to said hopper to provide said communication with said reservoir chamber, said hopper including means providing access into said reservoir chamber to permit the introduction of fresh particulate material into said apparatus.

9. The apparatus of claim 1 wherein said delivery means comprises means for lifting particulate material from said reservoir chamber and depositing it onto said porous support member within said housing.

10. The apparatus of claim 9 wherein said means for lifting includes structure defining a bore extending vertically between said reservoir chamber and said fluidization chamber and opening over said support member, a rotatable screw extending through said bore, and drive means for effecting rotation thereof so as to lift the particulate material.

11. The apparatus of claim 10 wherein the lower end of said bore-defining structure opens adjacent the bottom of said reservoir chamber, and wherein said apparatus additionally includes means for injecting air under pressure into said reservoir chamber, in the vicinity of said lower end of said structure, to effect agitation of particulate material thereat, said reservoir chamber being open to the atmosphere and said apparatus additionally including filter means effectively covering the opening to said reservoir chamber.

12. The apparatus of claim 1 devoid of means for evacuating said collection means and said reservoir chamber.

13. A system for coating the interior surface of objects, including:

electrostatic fluidized bed coating apparatus adapted for coating of interior surfaces of objects comprising, in combination: a housing having a generally planar porous support member mounted therein to define within said housing a shallow fluidization chamber thereabove and a plenum therebelow, said housing being open at the top and having a peripheral wall portion with an upper peripheral edge component extending about the opening thereinto; charging means for electrostatically charging particulate material supplied to the upper surface of said support member; means for introducing air into said plenum for fluidization of particulate material disposed on said upper surface; a covered reservoir chamber disposed below said plenum; delivery means for delivering particulate material from said reservoir chamber to said fluidization chamber; and collection means including at least one wall portion providing an upper edge component substantially surrounding said edge component of said peripheral wall portion of said housing and in substantial horizontal registry therewith; said edge components of said wall portion of said housing and collection means being spaced from one another to define a narrow, upwardly opening slot extending peripherally about said housing, said collection means being in communication with said reservoir chamber to permit particulate material entering said peripherally extending slot to fall into said reservoir chamber;

means for transporting an object to and away from the vicinity of said coating apparatus, said transporting means being adapted to support an open-ended object with its open end downwardly disposed; and means for effecting relative vertical movement between an object supported by said means for transporting and said coating apparatus.

14. The system of claim 13 wherein said means for transporting is adapted to support an object having an end wall closing an end thereof opposite its open end.

15. The system of claim 13 additionally including high voltage supply means connected to said charging means of said apparatus, and air supply means connected to said means for introducing air thereof, said system being devoid of means for evacuating any space within said apparatus.

16. The system of claim 13 wherein the outermost element of said peripheral edge component of said collection means is vertically spaced about 5 to 10 centimeters above said upper surface of said support member, and wherein said delivery means delivers the particulate material to a central location on said surface of said support member.

17. An electrostatic method for coating the inside surfaces of an elongated object having a cavity of uniform cross section and an open end, including the steps:

(a) providing an electrostatic fluidized bed coating apparatus comprising, in combination: a housing having a generally planar porous support member mounted therein to define within said housing a shallow fluidization chamber thereabove and a plenum therebelow, said housing being open at the top and having a peripheral wall portion with an upper peripheral edge component extending about the opening thereinto; charging means for electrostatically charging particulate material supplied to the upper surface of said support member; means for introducing air into said plenum for fluidization of particulate material disposed on said upper surface; a covered reservoir chamber disposed below said plenum; delivery means for delivering particulate material from said reservoir chamber to said fluidization chamber; and collection means including at least one wall portion providing an upper edge component substantially surrounding said edge component of said peripheral wall portion of said housing and in substantial horizontal registry therewith; said edge components of said wall portions of said housing and collection means being spaced from one another to define a narrow, upwardly opening slot extending peripherally about said housing, said collection means being in communication with said reservoir chamber to permit particulate material entering said peripherally extending slot to fall into said reservoir chamber;

(b) supplying a quantity of particulate material, capable of acquiring an electrostatic charge, to said upper surface of said support member;

(c) positioning over said coating apparatus an elongate object having an open end and a cavity of uniform cross section conforming closely to the outermost periphery of said upper edge component of said collection means, said object being oriented with its longitudinal axis vertically disposed and with said open end thereof downwardly directed;

(d) effecting relative vertical movement between said object and said apparatus during a cycle consisting of a first phase, in which said apparatus is inserted into said cavity of said object, and a second phase in which said apparatus is withdrawn therefrom;

(e) operating said apparatus during at least a portion of said cycle so as to produce from said particulate material, upon and over said support member, a fluidized bed and a cloud of electrostatically charged particles;

(f) maintaining said object, at least during said portion of said cycle, at an electrical potential that is effectively opposite to the potential of said electrostatically charged particles, so as to cause said particles to be attracted to, to deposit upon, and to adhere to the surfaces defining said cavity of said object, to effect coating thereof; and (g) continuously delivering, during said step (e), particulate material from said reservoir chamber to said fluidization chamber.

18. The method of claim 17 wherein said object has an end opposite to said one end and an end wall closing said opposite end, and wherein said housing of said apparatus is substantially completely open at the top, said apparatus being brought to a position proximate said end wall in said first phase of said cycle, and being in said position at the commencement of said step (e).

19. The method of claim 17 wherein the outermost element of said peripheral edge component of said collection means is vertically spaced about 5 to 10 centimeters above said upper surface of said support member, wherein, in said step (g), said material is delivered to a central location on said upper surface of said support member, and wherein said object is grounded.

20. The method of claim 17 wherein said step (e) is carried out substantially entirely during said second phase of said cycle.

21. The method of claim 17 wherein each of a plurality of said objects is sequentially so positioned and relatively moved.

22. The method of claim 21 wherein said relative movement occurs at a varying rate, and wherein said rate variation is automatically controlled in accordance with a predetermined program.

23. The method of claim 17 wherein collection and delivery of said particulate material by said apparatus is effected at a pressure that is no lower than atmospheric.

* * * * *